United States Patent [19]

Hasenack et al.

[11] Patent Number: 4,865,542

[45] Date of Patent: Sep. 12, 1989

[54] PARTIAL COMBUSTION BURNER WITH SPIRAL-FLOW COOLED FACE

[75] Inventors: Hendricus J. A. Hasenack, Amsterdam; Ian Poll, The Hague, both of Netherlands

[73] Assignee: Shell Oil Company, Houston, Tex.

[21] Appl. No.: 156,679

[22] Filed: Feb. 17, 1988

[51] Int. Cl.[4] ..... F23D 11/36; B05B 15/00

[52] U.S. Cl. ..... 431/160; 110/263; 110/265; 48/86 R; 48/DIG. 7; 239/132.3

[58] Field of Search ..... 239/132, 132.1, 132.3, 239/422, 423, 424, 433, 434.5; 48/86 R, DIG. 7, 197 R, 202, 203, 210; 110/263, 265; 431/160, 181, 187, 184; 122/6.5, 6.6, 6.7

[56] References Cited

U.S. PATENT DOCUMENTS

| | | | |
|---|---|---|---|
| 2,172,383 | 9/1939 | Honn | 239/132.1 |
| 3,175,817 | 3/1965 | Smith et al. | 239/132.3 X |
| 4,350,103 | 9/1982 | Poll | 110/347 X |
| 4,443,228 | 4/1984 | Schlinger | 239/132.3 X |
| 4,473,350 | 9/1984 | Gitman | 239/132.3 X |
| 4,523,529 | 6/1985 | Poll | 110/265 X |
| 4,525,175 | 6/1985 | Stellaccio | 239/132.3 X |
| 4,726,760 | 2/1988 | Stoog | 110/265 X |

FOREIGN PATENT DOCUMENTS

| | | | |
|---|---|---|---|
| 54950 | 7/1943 | Netherlands | 239/132.3 |
| 77366 | 9/1954 | Netherlands | 239/132.3 |
| 2151348 | 7/1985 | United Kingdom . | |

OTHER PUBLICATIONS

"Hydrocarbon Processing", Apr. 1986.

"Proceedings: Fifth Annual EPRI Contractors Conf. on Coal Gasification", 7/1986, Holt, pp. 7-6 and 7-15.

"Shell-Based Gasification-Combined Cycle Power Plant Evaluations", 6/1983, Hartman et al.

*Primary Examiner*—Robert E. Garrett

*Assistant Examiner*—Carl D. Price

*Attorney, Agent, or Firm*—Ronald R. Reper

[57] ABSTRACT

Disclosed is a burner for the partial combustion of a solid carbonaceous fuel wherein coal, e.g., finely divided coal, is supplied to a reactor space via a central channel disposed along the longitudinal axis of the burner, and oxygen-containing gas is supplied via two annular channels surrounding said central channel, and heat from the combustion is removed from the hollow front face of the burner by coolant flowed through said front face spirally about the longitudinal axis of the burner.

7 Claims, 1 Drawing Sheet

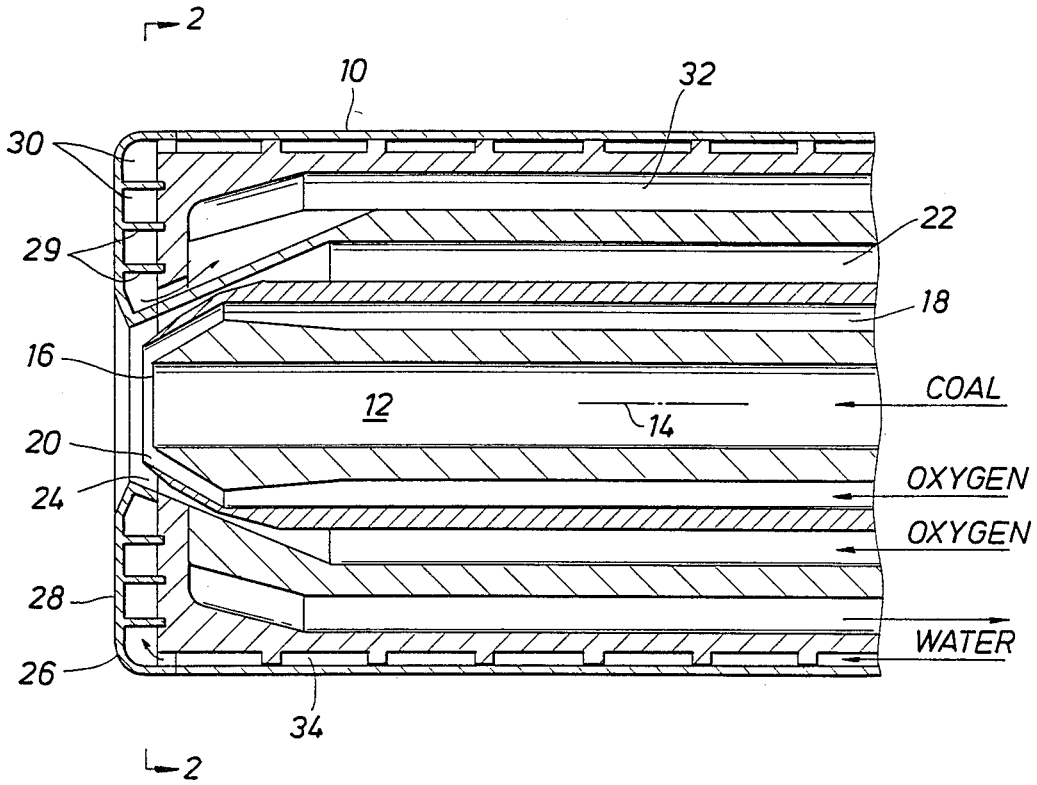
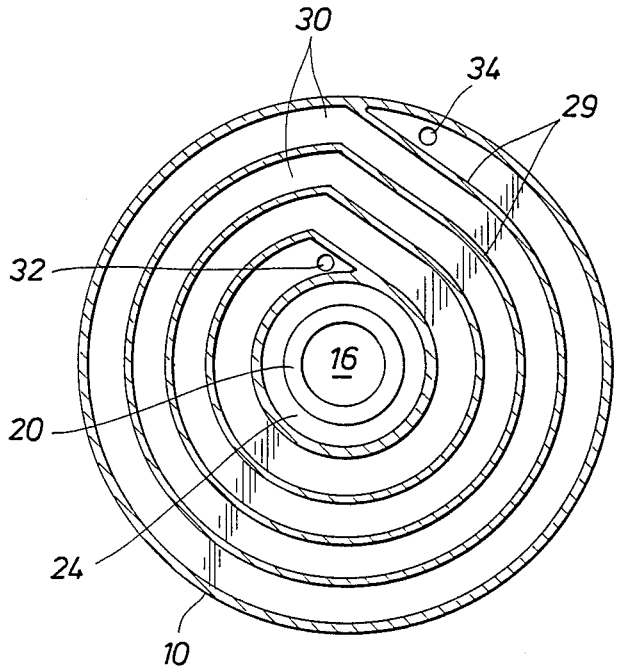
FIG. 2

PARTIAL COMBUSTION BURNER WITH SPIRAL-FLOW COOLED FACE

Related is patent application Ser. No. 156,675 filed of even date herewith directed to burner of similar construction but having a single annular passage encompassing the central channel.

BACKGROUND OF THE INVENTION

The invention relates to a burner for use in the partial combustion of carbonaceous fuels, and particularly for the partial combustion of finely divided solid fuel such as pulverized coal, in which the fuel is introduced together with an oxygen-containing gas into a reactor space operating under a pressure up to 100 bar for producing pressurized synthesis gas, fuel gas or reducing gas.

Partial combustion, also known as gasification, of a solid carbonaceous fuel is obtained by the reaction of the fuel with oxygen. The fuel contains as combustable components, mainly carbon and hydrogen, which react with the supplied oxygen—and possibly with any steam and carbon dioxide as may be present—to form carbon monoxide and hydrogen. At some temperatures it is also possible to form methane.

There are in principle two different processes for the partial combustion of solid fuel. In the first process, solid fuel in particulate form is contacted with an oxygen-containing gas in the reactor in a fixed or fluidized bed at a temperature below about 1000° C. A drawback of this method is that not all types of solid fuel can be partially combusted in this manner. For example, high swelling coal is unsuitable since particles of such coal type easily sinter, resulting in risk of clogging of the reactor.

A more advantageous process passes the finely divided fuel in a carrier gas such as nitrogen or synthesis gas into a reactor at relatively high velocity. In the reactor a flame is maintained in which the fuel reacts with oxygen-containing gas at temperatures above 1000° C. The carbonaceous fuel is usually passed into the reactor via a burner, and the oxygen-containing gas is also passed via the burner into the reactor. In some processes a moderator gas such as steam or carbon dioxide is also passed via the burner to the reactor; such a moderator gas is often advantageous for reducing or preventing premature contact of the oxygen with the reactor gas, which might result in undesirable complete conversion of the reactor gas.

The present burner is well suited to introduce the reactants in any desired manner, e.g., horizontally or vertically, into the reaction zone of a conventional, refractory lined partial oxidation gas generator, and is particularly suited for use in solid fuel gasification apparatus having a plurality of burners for the reactants positioned on substantially opposite sides of the combustion zone, whereby the reactants are introduced horizontally and the burner jets impinge on each other to facilitate the partial oxidation process and to minimize erosion of the refractory wall.

Since flame temperatures may exceed 2000° C. or more, a primary concern of such burners is to prevent damage to the burner front, also referred to as the burner face, caused by the high heat flux during the gasification process. To protect the burner front from overheating, it has been suggested to provide a refractory lining applied to the outer surface of the burner front wall and/or provide a hollow wall member with internal cooling passages through which cooling fluid is circulated at a rapid rate. The present invention provides an improved burner wherein the cooling fluid is caused to flow in a particular manner to assure even cooling of the burner front face so as to minimize thermal stresses which could cause deterioration and even failure of the burner during prolonged operation.

SUMMARY OF THE INVENTION

In accordance with the invention there is provided a burner for the partial combustion of finely divided solid carbonaceous fuel with an oxygen containing gas in a combustion zone, said burner comprising:

a central channel and outlet for supplying fuel to the combustion zone;

a first substantially annular channel disposed coaxially with said central channel and having an outlet to supply a first oxygen-containing gas flow to the combustion zone;

a second substantially annular channel disposed coaxially with said first annular channel and having an outlet to supply a second gas flow to the combustion zone;

a front face disposed at the discharge end of said burner and normal to the longitudinal axis thereof, said front face having a central aperture through which said fuel and said first oxygen-containing gas and said second gas flow to the combustion zone; said front face comprising a hollow wall member operatively connected to: (a) a supply conduit disposed to supply fluid coolant to the proximate first end of a passageway in said hollow wall member; (b) a return conduit disposed to pass fluid coolant proximately from the other end of said passageway; and including (c) spiral flow means defining said passageway disposed within said hollow wall member to cause fluid coolant entering said hollow wall member from said supply conduit to flow in a spiral direction about the longitudinal axis of the burner.

The invention provides a burner that is capable of operation for extended periods of time without subjecting the front face and other burner components to excessive stress.

BRIEF DESCRIPTION OF THE INVENTION

The invention will now be described in more detail, by way of example only, with reference to the accompanying drawings, wherein:

FIG. 1 is a longitudinal section of the front part of a burner according to the invention; and FIG. 2 shows a cross-section of 2—2 of FIG. 1.

DESCRIPTION OF PREFERRED EMBODIMENTS

It should be noted that identical elements shown in the drawings have been indicated with the same reference numeral.

Referring to FIGS. 1 and 2, a burner, generally indicated with the reference numeral 10, for the partial combustion of a carbonaceous fuel, such as pulverized coal comprises central channel 12 disposed along longitudinal axis 14, and having a discharge outlet 16 for supplying a finely divided solid fuel in a carrier gas, e.g., nitrogen, carbon dioxide, or synthesis gas, to a combustion zone. Concentrically arranged around the central channel 12 is first substantially annular channel 18 for oxygen-containing gas having free end 20 forming an outlet for the oxygen-containing gas flow into the combustion zone. Preferably outlet 20 is disposed at an angle of from about 15 to about 60 degrees with respect to the longitudinal axis 14 so that the issuing stream of oxygen-containing gas will intersect and mix with the stream of solid fuel issuing from outlet 16. Arranged concentrically around said first annular channel 18 is second substantially annular channel 22 for a second gas, which may be oxygen-containing gas, a moderator gas such as, e.g., steam or carbon dioxide, or a mixture or oxygen-containing gas and moderator gas, and having free end 24 forming an outlet for a second gas flow into the combustion zone. Said outlet 24 will generally be disposed at a similar angle with respect to the longitudinal axis 14, but preferably will be more divergent, i.e., less acute when said second annular channel will be used to supply moderating or shielding gas to the combustion zone. The ratio of the cross sectional area for the second annular channel divided by the cross sectional area for the first annular channel is in the range from about 0.5 to 2, such as 0.75 to 1.5. Conventional separators are used for radially spacing the channels from each other, for example, alignment pins, fins, centering vanes, spacers and other conventional means are used to symmetrically space the channels with respect to each other and to hold same in stable alignment with minimal obstruction to the free flow of the reactant streams.

The burner 10 further comprises a cylindrical hollow wall member 26 having an enlarged end part forming a front face 28 which is normal to the longitudinal axis 14 of the burner. The hollow wall member is interiorly provided with spiral flow means 29, which may be somewhat pervious to fluids, but preferably is a fluid impervious barrier forming a spiral channel 30, said channel having one end operatively connected to supply conduit 34 for supplying fluid coolant to said spiral channel and having the other end of said spiral channel operatively connected to return conduit 32 to pass fluid coolant from said channel 30. The supply conduit may be operatively connected to either end of the spiral channel, and the return conduit to the other end, as desired. However, it is preferred that the supply conduit provide the fluid coolant, particularly a liquid coolant such as tempered water to the outside end of spiral channel 30.

It is an advantage of the present invention that it permits convective and radiant heat transfer from combustion of the reactants downstream of the burner face while avoiding, substantially or altogether, boiling of the coolant liquid within the hollow wall member. The use of high velocity coolant through the spiral channel assures even, low metal temperature in the burner face thereby enabling long life of the burner. When water is used as coolant, preferably it is supplied to the hollow wall member at a flow rate sufficiently high that at maximum heat output of the burner, the water entering the return conduit will have increased no more than about 5° C., and most preferably less than about 3° C. It is found advantageous to employ as coolant tempered water having a temperature in the range below about 210° C.

During operation of the above described burner 10 for the gasification of carbonaceous fuel, e.g., pulverized coal, by means of oxygen-containing gas, said coal suspended in a carrier fluid such as, e.g., nitrogen, synthesis gas or carbon dioxide, is passed through the central channel 12 to outlet 16 for introducing the coal into the combustion zone of a reactor arranged downstream of the burner. Simultaneously, oxygen-containing gas is passed through annular channel 18 to outlet 20 so that the coal and oxygen-containing gas reactants will be intensively mixed in the reactor space. The mixing of the reactants can be further promoted by a swirling motion imparted to one or both streams by a swirl body of baffles (not shown) in the appropriate channel. To promote stable outflow of coal the cross sectional area available for the coal flow should be kept constant over at least part of central channel 12 of the burner near the outlet.

During operation of the burner for the gasification of pulverized fuel a second gas which may be oxygen-containing gas, a temperature moderating gas such as steam, carbon dioxide or nitrogen, or a mixture of oxygen-containing gas and moderating gas, is conveyed through annular channel 22 to outlet 24 to supply additional oxygen as needed, and when said second gas flow contains substantial amounts of moderator gas, forms a shield around the jets issuing coal and oxygen. The shield of moderator gas may be advantageous for preventing premature contact of oxygen with the reactor gas, which might result in undesirable complete conversion of the reactor gas. It is preferred to operate by supplying oxygen-containing gas through both channels, at a mean velocity in the range from about 35 to about 100 meters/second, supplying said gas through said first (centermost) annular channel outlet at a somewhat lower velocity than the velocity of gas supplied to the combustion zone through said second annular channel outlet.

The rate of flow for each of the streams of the pulverized fuel, the oxygen-containing gas and of the second gas is controlled by a flow control valve in each feedline to the burner. The burner firing rate, i.e., turnup or turndown of the burner, is effected by changing the flow rate for each of the streams while maintaining a substantially constant ratio of atomic oxygen to carbon in the solid feed. Generally an oxygen demand of 0.9 to 1 ton per ton of moisture and ash-free coal is fairly typical of hard coals; for low rank coals 0.7 tons oxygen per ton is more representative. It is an advantage of the instant burner in addition to its durability that it has a channel for admitting a second gas to the combustion zone that permits great flexibility in supplying the reactants under a wide variety of operational requirements.

The burner will ordinarily be fabricated of high temperature resistant materials, particularly high temperature resistant metals and alloys such as sold under the trade name Inconel and be fabricated by techniques of welding and/or brazing conventionly employed with such materials. For high duty operations the channels and outlets for oxygen containing gas, which are usually made of metal, and may be internally coated with an oxidic coating, such as $ZrO_2$, or a ceramic, enabling the application of high oxygen-containing gas velocities without the risk of metal combustion by the oxygen.

The term solid carbonaceous fuel as used herein is intended to include various materials and mixtures thereof from the group of coal, coke from coal, coal liquefication residues, petroleum coke, soot, and particulate solids derived from oil shale, tar sands and pitch. The coal may be of any type, including lignite, subbituminous, bituminous and anthracite. The solid carbonaceous fuels are preferably ground to a particle size so that at least about 90% of the material is less than 90 microns and the moisture content is less than about five per cent weight.

The term "oxygen-containing gas" as used herein is intended to refer to gas containing free oxygen, i.e., uncombined oxygen, and to include air oxygen-enriched air, i.e., greater than 21% mole oxygen, and also substantially pure oxygen, i.e., greater than about 95% mole oxygen, with the remainder comprising gases normally found in air such as nitrogen and the rare gases.

What is claimed is:

1. A burner for the partial combustion of finely divided solid carbonaceous fuel with an oxygen containing gas in a combustion zone, said burner having a longitudinal axis, and a discharge end, which burner comprises:

a central channel disposed along said longitudinal axis of said burner and having an outlet at said discharge end for supplying said solid fuel to the combustion zone;

a first substantially annular channel disposed coaxially with said central channel and having an outlet at said discharge end to supply oxygen-containing gas flow to the combustion zone;

a second substantially annular channel disposed coaxially with said first annular channel and having an outlet at said discharge end to supply a second gas flow to the combustion zone;

a front face disposed at the discharge end of said burner and normal to the longitudinal axis thereof, said front face having a central aperture through which said fuel, first oxygen-containing gas, and second gas flow to the combustion zone; said front face comprising a hollow wall member operatively connected to (a) a supply conduit disposed to supply fluid coolant proximately to a first end of a passageway in said hollow wall member; (b) a return conduit disposed to pass fluid coolant proximately from a final end of said passageway; and including (c) spiral flow means defining said passageway disposed within said hollow wall member to cause fluid coolant entering said hollow wall member from said supply conduit to flow in a spiral direction about the longitudinal axis of the burner.

2. The burner of claim 1 wherein said spiral flow means comprises a continuous impervious barrier forming a spiral channel within said hollow wall member.

3. The burner of claim 1 wherein said first and second annular channels are each separately connected to oxygen-containing gas sources which are independently controllable as to pressure and flow rate.

4. The burner of claim 1 wherein said supply conduit is operatively connected to the outside end of said spiral passageway to supply liquid coolant thereto.

5. The burner of claim 1 wherein the outlet of said first annular channel is disposed at an angle of from about 16 to about 60 degrees with respect to said longitudinal axis of said burner.

6. The burner of claim 1 wherein the ratio of cross sectional area for said second annular channel to the cross sectional area of said first annular channel is in the range from about 2.5 to 2.

7. The burner of claim 6 wherein said ratio is in the range of 0.75 to 1.5.

* * * * *